US006136768A

United States Patent [19]

Dawson et al.

[11] Patent Number: 6,136,768

[45] Date of Patent: Oct. 24, 2000

[54] DRAIN CLEANER

[75] Inventors: Hilton G. Dawson, Canton; Robert P. Warnock; Richard A. DeSenna, both of Marietta, all of Ga.

[73] Assignee: Chem-Link Laboratories LLC, Kennesaw, Ga.

[21] Appl. No.: 09/387,474

[22] Filed: Sep. 1, 1999

Related U.S. Application Data

[60] Provisional application No. 60/114,837, Jan. 6, 1999.

[51] Int. Cl.[7] ..... C11D 7/06; C11D 7/54; C11D 7/60; B08B 9/027

[52] U.S. Cl. ..... 510/195; 510/196; 510/380; 510/381; 510/445; 510/446; 510/478; 510/488; 510/509; 134/22.11; 134/22.13; 134/22.17

[58] Field of Search ..... 510/195, 196, 510/380, 381, 445, 446, 478, 488, 509; 134/22.11, 22.13, 22.17

[56] References Cited

U.S. PATENT DOCUMENTS 3,968,048 7/1976 Bolan ..... 510/196
4,058,474 11/1977 Keyes et al. ..... 510/196
4,664,836 5/1987 Taylor, Jr. et al. ..... 510/196
5,630,883 5/1997 Steer et al. ..... 134/22.13
5,783,537 7/1998 Ahmed et al. ..... 510/193
5,931,172 8/1999 Steer et al. ..... 134/22.13

*Primary Examiner*—Lorna M. Douyon
*Attorney, Agent, or Firm*—James W. Kayden; Thomas, Kayden, Horstemeyer & Risley

[57] ABSTRACT

A water-dispersible effervescent drain cleaner having a composition of approximately 20–60% by weight of a mixture of metal hydroxides, 20–40% hypochlorite generator, and 10–40% effervescent materials. Lubricant, colors and fragrances may also be present. The components of this mixture are compressed into tablet, pellet, granules, or high density powder forms. The particles are of sufficient density to drop through water to the point of a clog. The effervescent materials work to break up the tablets or pellets and to agitate the mixture. The hypochlorite generator, in conjunction with the hydroxides reacts to dissolve hair. The hydroxide and hypochlorite generate heat, which will dissolve grease and soap clogs and accelerate the dissolution of hair.

20 Claims, No Drawings

DRAIN CLEANER

This application claims the benefit of U.S. Provisional Application Ser. No. 60/114,837, filed Jan. 6, 1999.

BACKGROUND OF THE INVENTION

This invention relates to drain cleaners. Typical drain cleaners known to exist on the market are either liquid or granular.

Generally, the granular products contain sodium hydroxide, sodium nitrate, and aluminum. Sodium hydroxide is usually the largest component in these mixtures. The sodium hydroxide generates heat as it dissolves in water and reacts with the aluminum, thereby melting grease, soap, etc. which clog drains. Saponification of fats occurs due to the generated heat, changing the grease into a soap-like substance, which is more easily rinsed down the drain. Ammonia gas is generated to provide agitation and expose the clog to fresh sodium hydroxide. Most granular drain cleaners do not effectively remove hair clogs, as they contain no oxidizing agents. Generally dry oxidizers and hydroxides are not stable together.

The common liquid drain cleaners dissolve hair. They contain sodium or lithium hydroxide and sodium or lithium hypochlorite. The hydroxides are virtually ineffective against grease or soap build up because they are already in liquid form and therefore have no, or very little, heat of solution. Most liquid drain cleaners flow to the bottom of the trap or to the top of the clog due to their high density. This reduces the dilution caused by standing water and places more concentrated cleaner in contact with the clog.

Taylor et al., U.S. Pat. No. 4,664,836, teaches the use of a free-flowing crystalline drain cleaner composed of at least 40% coated alkali metal hydroxide and 5–20% hypochlorite generator and peroxide generator. The alkali metal hydroxide is coated to prevent the alkali metal hydroxide from reacting with the other components of the mixture. The peroxide generator produces peroxide which reacts to make the primary effervescent, dioxygen.

Steer et al., U.S. Pat. No. 5,630,883, teaches the method of removing a restriction from a drain system with the use of a non-caustic opening active in the drain cleaner. The non-caustic drain cleaner operates while maintaining a flow-through state in the pipe system.

SUMMARY OF THE INVENTION

The drain cleaner of the present invention incorporates at least one metal hydroxide and at least one hypochlorite generator into a stable pellet, tablet, granules, or high density powder. Additionally, the drain cleaner incorporates at least one effervescent system composed of at least one metal carbonate and at least one acid. Further, binding and lubricating agents may be added.

The metal hydroxide represents about 20% to about 60% by weight of the total weight of the drain cleaner. The hypochlorite generator represents about 20% to about 40% by weight of the total weight of the drain cleaner. The effervescent system represents about 10% to about 40% by weight of the total weight of the drain cleaner. The lubricating agent represents about 1% to about 10% by weight of the total weight of the drain cleaner. The binding agent represents about 1% to about 10% by weight of the total weight of the drain cleaner.

This invention also describes a method of substantially removing a restriction that may be composed of hair, grease, soap, organic material, or other deposits from a drain pipe system having liquid therein. The method involves introducing into the drain pipe system having a restriction a dry drain cleaning composition that includes a caustic drain opening active composition and an effervescent system. The caustic drain opening active includes about 20% to about 60% by weight of at least one metal hydroxide. The metal hydroxide may be an alkali or alkaline hydroxide. Additionally, the caustic drain opening active includes about 20% to about 40% by weight of at least one hypochlorite generator. The effervescent system includes about 10% to about 40% by weight of at least one alkali metal carbonate and at least one acid. The caustic drain cleaner is allowed to settle substantially near the restriction for a sufficient period of time so that the restriction is substantially degraded.

This invention further describes a method of producing a dry drain cleaning composition that may be composed of a caustic compound and a chlorinated compound that is shelf-stable. The method involves mixing a caustic compound with binders and lubricants to form a caustic mixture in a moisture-controlled environment. Then the method involves placing the caustic mixture and a chlorinated compound into an atmospheric-resistant pouch in a moisture controlled environment. The method then involves sealing the said atmospheric-resistant pouch in a moisture-controlled environment.

DETAILED DESCRIPTION OF THE PREFERRED EMBODIMENT

The present invention is a water-dispersible, effervescent drain cleaning tablet, pellet, granules, or high density powder primarily composed of a metal hydroxide, a hypochlorite generator, and an effervescent system. Additionally, binders and lubricants may be implemented. The chemicals used to make the drain cleaner may be anhydrous. The chemicals are of a particle size of less than or equal to 40 mesh. The drain cleaning composition is a shelf-stable combination of alkali and chlorine compounds.

The drain cleaner removes clogs through various mechanisms. One mechanism is that when the metal hydroxides dissolve, through an exothermic reaction, heat is produced, specifically the dissolution of sodium hydroxide. The heat produced melts grease and soap. Additionally, the high alkalinity created by the metal hydroxides creates an environment that makes hair and other proteins in the clog soluble. A second mechanism is when the hypochlorite generator dissolves in the presence of alkali, heat is produced through an exothermic reaction, specifically the dissolution of dichloroisocyanurate. Furthermore, the hypochlorite oxidizes hair and other proteins, thus dissolving that portion of the clog. Another mechanism is that the effervescent, in addition to dispersing the present material, creates an agitating action which aids in breaking up the clog.

The drain cleaner is carefully prepared, stored, and packaged to prevent moisture from initiating premature decomposition of the drain cleaning components, which would render it less effective. The drain cleaner is produced in a moisture controlled atmosphere. This is done to inhibit the metal hydroxide, often hygroscopic, from adsorbing moisture from the air. If the metal hydroxide adsorbs water, a highly alkaline solution is created on the surface of the metal hydroxide. When the metal hydroxide comes into contact with the hypochlorite generator a reaction occurs and the drain cleaner is rendered less effective. One way to preclude this from occurring is to mix and granulate the metal hydroxide, effervescent, binders, and lubricants together, hereinafter hydroxide granulate. Separately, the hypochlorite generator is granulated, hereinafter hypochlorite granulate. Then both of the hydroxide and hypochlorite granulates are placed into single application atmospheric-resistant pouches. Each hydroxide granulate has a number of components, so that not any one particular component is on 100% of the surface of the granule. This decreases the likelihood that the metal hydroxide comes into contact with moisture or the hypochlorite generator. Thus, the preparation and packaging of the drain cleaner decreases the possibility of premature decomposition.

Additionally, this invention describes a method of substantially removing a restriction that may be composed of hair, grease, soap, organic material, or other deposits from a drain pipe system having liquid therein. The method involves introducing into the drain pipe system having a restriction a dry drain cleaning composition that includes a caustic drain opening active composition and an effervescent system. The caustic drain opening active includes about 20% to about 60% by weight of at least one metal hydroxide. The metal hydroxide may be an alkali or alkaline hydroxide. Additionally, the caustic drain opening active includes about 20% to about 40% by weight of at least one hypochlorite generator. The effervescent system includes about 10% to about 40% by weight of at least one alkali metal carbonate and at least one acid. The caustic drain cleaner is allowed to settle substantially near the restriction for a sufficient period of time so that the restriction is substantially degraded.

Furthermore, this invention describes a method of producing a dry drain cleaning composition that may be composed of a caustic compound and a chlorinated compound that is shelf-stable. The method involves mixing a caustic compound with binders and lubricants to form a caustic-mixture in a moisture-controlled environment. Then the method involves placing the caustic-mixture and a chlorinated compound into an atmospheric-resistant pouch in a moisture controlled environment. Then the method involves sealing the said atmospheric-resistant pouch in a moisture-controlled environment.

The drain cleaning composition contains metal hydroxides. The metal hydroxides include, but are not limited to, alkali and alkaline hydroxides. The metal hydroxides may be selected from one or more of the following: sodium hydroxide, lithium hydroxide, potassium hydroxide, rubidium hydroxide, cesium hydroxide, calcium hydroxide, strontium hydroxide, and barium hydroxide. More particularly, the metal hydroxides are a powdered form of sodium hydroxide and/or lithium hydroxide. The hydroxides represent 20–60% by weight, of the total weight of the drain cleaner.

Additionally, the drain cleaner is composed of a hypochlorite generator. The hypochlorite generator may include, but is not limited to, one or more of the following: chlorinated isocyanurates, calcium hypochlorite, lithium hypochlorite, magnesium hypochlorite, alkali earth metal hypochlorites, and alkaline earth metal hypochlorites. More particularly, the hypochlorite generator used is an anhydrous form of dichloroisocyanurate. The hypochlorite generator represents 20–40% by weight, of the total weight of the drain cleaner.

Further, the drain cleaner is composed of an effervescent system. The effervescent system is composed of one or more of an alkali metal carbonate and an acid. One or more alkali metal carbonates may be selected from the following: sodium carbonate, sodium bicarbonate, and potassium carbonate. More particularly, sodium carbonate is used as the alkali metal carbonate. Furthermore, one or more acids may be selected from the following: citric, maleic, fumeric, adipic, oxalic, lactic, sulfamic, and sodium bisulphate. More particularly, citric acid is used as the acid. The effervescent system, summation of the alkali metal carbonate and the acid, represents 10–40% by weight, of the total weight of the drain cleaner.

In addition, the drain cleaner is composed of a lubricating agent, which limits sticking. The lubricant that may be used can be selected from, but not limited to, the following: sodium benzoate, stearates, mineral oil, silicates, or algenic acid. More particularly, sodium benzoate is used as the lubricating agent. The lubricant represents 1–10% by weight, of the total weight of the drain cleaner.

Additionally, the drain cleaner may be composed of a binder. The binder that may be used can be selected from, but is not limited to, the following: polyethylene glycol (PEG) or sorbitol. The binder represents 1–10% by weight, of the total weight of the drain cleaner.

Coloring agents and fragrance may be added to the drain cleaner and represent 0.1–10% by weight, of the total weight.

Table 1 contains two representative examples of drain cleaner compositions, A and B.

TABLE 1

| | Granular Drain Cleaner | |
|---|---|---|
| | Ingredient | Wt. % |
| Composition A | NaOH powder | 39.55 |
| | Sodium Carbonate | 13.07 |
| | Citric Acid | 13.07 |
| | PEG 8000 | 3.35 |
| | Sorbitol | 3.35 |
| | Sodium Benzoate | 1.30 |
| | Dichloroisocyanurate | 26.31 |
| | Total = | 100 |
| Composition B | NaOH powder | 35.2 |
| | LiOH powder | 7 |
| | Sodium Carbonate | 14 |
| | Citric Acid | 14 |
| | Sodium Benzoate | 1.4 |
| | Dischloroisocyanurate | 28 |
| | Total = | 99.6 |

A series of experiments were performed using the drain cleaners of Composition A and Composition B. These experiments include the drain cleaner's ability to dissolve hair, and grease, which are often the cause of clogs. All of the experiments were performed at ambient temperatures. Deionized water was used in all of the experiments and was recorded at 21–25° C. Comparison tests were done involving several commercially available drain cleaning products. A local salon provided hair. The soap was a typical bath bar soap. The grease was an all-vegetable shortening and/or lard.

EXAMPLE 1

Hair Dissolution

One series of experiments focused on the dissolution of hair. Samples of 0.1 g of hair were weighed and placed into 25×150 mm test tubes. Sample amounts were approximately 25 ml, for each of the commercially available liquid drain cleaners. These amounts were placed into beakers along with corresponding amounts of deionized water to fill to a volume of 50 ml. Separately, 50 ml of deionized water was placed into a tube containing hair. Next, the mixtures of the name brand drain cleaners were added to the test tubes containing hair. Then 7.1 g of the drain cleaner of Composition B was placed into the tube containing hair and 50 ml of deionized water. A stopwatch was used to time the dissolution of hair. In repeated tests, the hair in the tube containing the present invention consistently dissolved the hair in about a third of the time required for the commercially available liquid drain cleaning products. Similar results occurred, performing the same experiments as above, but with 7.5 g of drain cleaner of Composition A. As with Composition B, Composition A dissolved the hair in about a third of the time required for the commercially available liquid drain cleaning products.

EXAMPLE 2

Grease Dissolution

Another set of experiments show the ability of drain cleaners of Composition A and Composition B to dissolve grease comprised of an all-vegetable shortening and/or lard. The grease was melted in a microwave oven and then combined with hair. This molten mixture was poured into a test tube containing chilled deionized water. A plug or clog of grease and hair was formed on top of the water. A pre-measured amount of Composition A was added to the tube. Likewise, a pre-measured amount of Composition B was added to the tube. Within about ten minutes both drain cleaner compositions had produced a hole through the clog. Within about thirty minutes the clog had completely separated from the sides of the tube. Most of the hair that was not contained in the remaining curd was dissolved. The size of the curd was reduced by approximately half in about ten minutes.

While all of the brand name liquid drain cleaners typically contained alkali metal hydroxides, no heat is produced when mixed with water because they are already in a solution. Because of this fact, the brand name liquid drain cleaner products have little effect on grease or soap which are common components in a clog. The present drain cleaners contain anhydrous alkali metal hydroxides, which produce heat when placed in water. The liquid within the tubes containing the present invention typically increases in temperature 25–45° C. This is sufficient to melt through a clog of grease, hair and/or soap.

EXAMPLE 3

Glass pipe p-traps clogged with hair and grease

Another set of experiments show the ability of drain cleaners of Composition A and Composition B to dissolve hair and grease in a pipe system. All piping is 1½" diameter. Three glass p-traps are attached, by rubber couplings, to a PVC manifold and drainpipe. Each p-trap has a 18" tall glass stand pipe attached with a rubber coupling. In each p-trap a ring made of tubing is secured into place with silicone.

The clog consists of 10 ml of molten grease poured onto a paper towel disk, which rests on the ring inside each p-trap. The paper towel disks being previously dipped in molten shortening/lard and chilled until firm. The disks are placed on the rings inside the p-traps and cemented into place with 2 ml of molten shortening/lard. Next, 10 ml of molten shortening/lard is poured onto the coated paper towel disks. On top of the shortening clogs, 1.0 g of human hair was placed. A second ring was secured in the top of the p-trap to prevent the hair from floating during the test. In two p-traps 100 ml of deionized water was added. In the third p-trap 372 ml of deionized water was added. In the p-traps containing 100 ml deionized water, 300 ml of two commercially available liquid drain cleaners were added. In the remaining p-trap 28 g of drain cleaner of Composition A was added.

The drain cleaner of Composition A began to effervesce immediately after being added. Within two minutes the drain cleaner of Composition A had melted through the shortening clog allowing the water in the standpipe to drain out of the p-trap. Most of the hair had been flushed out of the drain cleaner of Composition A p-trap. The hair remaining dissolved within eight minutes. Similar results occurred when the drain cleaner of Composition B was used in place of the drain cleaner of Composition A.

The other commercially available drain cleaners did not affect the grease clog after more than an hour of contact. In fact, the clogs were left for four days with no change. Both of the commercially available drain cleaners dissolve the hair contained in the traps in about thirty minutes.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiments(s) of the invention without departing substantially from the spirit and principles of the invention. All such modifications and variations are intended to be included herein within the scope of the present invention and protected by the following claims.

We claim:

1. A dry drain cleaning composition, comprising component mixture of:

about 20% to about 60% by weight of at least one metal hydroxide;

about 20% to about 40% by weight of at least one hypochlorite generator; and about 10% to about 40% by weight of at least one effervescent system comprising at least one alkali metal carbonate and at least one acid.

2. The composition of claim 1, wherein said at least one metal hydroxide is selected from the group consisting of alkali and alkaline hydroxides.

3. The composition of claim 1, wherein said at least one metal hydroxide is selected from the group consisting of sodium hydroxide, lithium hydroxide, potassium hydroxide, rubidium hydroxide, cesium hydroxide, calcium hydroxide, strontium hydroxide, and barium hydroxide.

4. The composition of claim 1, wherein said at least one metal hydroxide is selected from the group consisting of sodium hydroxide and lithium hydroxide.

5. The composition of claim 1, wherein said at least one hypochlorite generator is selected from the group consisting of chlorinated isocyanurates, calcium hypochlorite, lithium hypochlorite, magnesium hypochlorite, alkali earth metal hypochlorites, and alkaline earth metal hypochlorites.

6. The composition of claim 1, wherein said at least one hypochlorite generator comprises chlorinated isocyanurates.

7. The composition of claim 1, wherein said at least one alkali metal carbonate is selected from the group consisting of sodium carbonate, sodium bicarbonate, and potassium carbonate.

8. The composition of claim 1, wherein said at least one alkali metal carbonate comprises sodium carbonate.

9. The composition of claim 1, wherein said at least one acid is selected from the group consisting of citric, maleic, fumaric, adipic, oxalic, lactic, sulfamic, and sodium bisulphate.

10. The composition of claim 1, wherein said at least one acid comprises citric acid.

11. The composition of claim 1, wherein said composition includes at least one lubricant selected from the group consisting of sodium benzoate, stearates, mineral oil, silicates, and algenic acid.

12. The composition of claim 1, wherein said composition includes at least one binder selected from the group consisting of polyethyene glycol and sorbitol.

13. The composition of claim 1, wherein said component mixture is anhydrous.

14. The composition of claim 1, wherein said component mixture is of a particle size less than or equal to 20 mesh.

15. The composition of claim 1, wherein the said composition is selected from the group consisting of a granule, pellet, and tablet.

16. The composition of claim 1, wherein the said composition comprises a high density powder.

17. A method of substantially removing a restriction that may be composed of hair, grease, soap, organic material, or other deposits from a drain pipe system having liquid therein comprising the steps of:

introducing into the drain pipe system having a restriction a dry drain cleaning composition comprising a caustic drain opening active composition comprising;

about 20% to about 60% by weight of at least one metal hydroxide selected from the group consisting of an alkali and alkaline hydroxide; and 20% to about 40% by weight of at least one hypochlorite generator;

and about 10% to about 40% by weight of an effervescent system comprising at least one alkali metal carbonate and at least one acid;

allowing the said dry drain cleaning composition to settle substantially near the restriction; and allowing the said dry drain cleaning composition to remain in contact with the restriction for a sufficient time to substantially degrade the restriction.

18. A method of producing a dry drain cleaning composition according to claim 1 that is shelf-stable comprising the steps of:

mixing a metal hydroxide with binders and lubricants to form a caustic-mixture in a moisture-controlled environment;

placing said caustic-mixture and a hypochlorite generator into an atmospheric-resistant pouch in a moisture controlled environment; and sealing the said atmospheric-resistant pouch in a moisture-controlled environment.

19. The method of claim 18, wherein the metal hydroxide is selected from the group consisting of alkali and alkaline hydroxides.

20. The method claim 18, wherein the hypochlorite generator is selected from the group consisting of chlorinated isocyanurates.

* * * * *

UNITED STATES PATENT AND TRADEMARK OFFICE

CERTIFICATE OF CORRECTION

PATENT NO. : 6,136,768
DATED : October 24, 2000
INVENTOR(S) : Dawson et al.

It is certified that error appears in the above-identified patent and that said Letters Patent is hereby corrected as shown below:

Column 6,
Line 35, delete "about" before "20%".

Signed and Sealed this

Twenty-sixth Day of June, 2001

*Attest:*

Nicholas P. Godici

NICHOLAS P. GODICI
*Acting Director of the United States Patent and Trademark Office*

*Attesting Officer*